United States Patent [19]

Myhres

[11] Patent Number: 4,811,176

[45] Date of Patent: Mar. 7, 1989

[54] FLASHLIGHT

[76] Inventor: Ralph Myhres, 5620 Farrington Rd., Port Angeles, Wash. 98362

[21] Appl. No.: 186,550

[22] Filed: Apr. 27, 1988

[51] Int. Cl.[4] ..... F21L 7/00

[52] U.S. Cl. ..... 362/205; 200/60

[58] Field of Search ..... 362/200, 201, 204, 205, 362/206; 200/60

[56] References Cited

U.S. PATENT DOCUMENTS

| | | | |
|---|---|---|---|
| 1,257,596 | 2/1918 | Ford | 362/205 |
| 1,365,988 | 1/1921 | Hambuechen . | |
| 1,377,477 | 5/1921 | Hambuechen . | |
| 2,271,421 | 1/1942 | Gits | 240/10.66 |
| 2,731,545 | 1/1956 | Bolinger | 240/10.68 |
| 2,931,005 | 3/1960 | Saurwein et al. | 362/205 X |
| 3,261,972 | 7/1966 | Stahl | 240/10.66 |
| 4,570,208 | 2/1986 | Sassmannshausen | 362/205 X |

*Primary Examiner*—Allen M. Ostrager

*Attorney, Agent, or Firm*—Ward Brown; Robert W. Beach

[57] ABSTRACT

A tubular battery-receiving casing has a resilient member at one end urging a first conductor into electrical contact with one terminal of a battery assembly. Such first conductor includes a portion extending lengthwise along a side of the casing. At the other end of the casing, a lamp assembly has a conductor with a V-shaped annular portion forming a flared groove. Such annular portion is in electrical contact with the other battery terminal through the positive and negative terminals of a lamp. A switch member in the form of a long loop of conductive material return bent at both ends is slidable lengthwise of the casing to connect and disconnect the base and lamp conductors. The leading end of the switch loop fits in the flared groove of the conductor for a reliable electrical connection.

9 Claims, 2 Drawing Sheets

FLASHLIGHT

BACKGROUND OF THE INVENTION

1. Field of the Invention

The present invention relates to a flashlight of the general type having a tubular casing for one or more batteries, a fixed base conductor positioned to engage one battery terminal, a fixed lamp assembly including a conductor in electrical contact with the other battery terminal, and a sliding switch operable to connect electrically the base and lamp conductors to complete the circuit and actuate the lamp.

2. Prior Art

A representative sampling of prior flashlight constructions are shown in the following U.S. Pat. Nos. 1,365,988, to Hambuechen issued Jan. 18, 1921; 1,377,477, to Hambuechen issued May 10, 1921; 1,257,596, to Ford issued Feb. 26, 1918; 3,261,972, to Stahl issued July 19, 1966; 2,271,421, to Gits issued Jan. 27, 1942; 2,731,545, to Bolinger issued Jan. 17, 1956. In each of the two patents issued to Hambuechen, at the leading or bulb end portion of the flashlight there is a fore-and-aft movable contact "blade" with a bent leading end for bridging between conductive rings which are spaced apart. Conductive contact between the rings is necessary to complete the circuit to power the lamp. The other patents disclose various forms of longitudinally slidable switch members for connecting and disconnecting fixed conductors located at opposite end portions of the tubular flashlight casing.

Known flashlight constructions rely on the resiliency of a switch member in the form of a thin conductive strip to complete the electrical circuit. Over time, the strip can become deformed so as not to make a reliable connection. Sometimes shaking the flashlight to rattle the internal batteries is required to complete the connection, or the flashlight must be dismantled for repair of the switch conductor.

SUMMARY OF THE INVENTION

The principal object of the present invention is to provide a novel flashlight construction utilizing fixed conductors at generally opposite end portions of a tubular battery-containing casing with a slidable switch member which will reliably connect and disconnect the conductors electrically to actuate and deactuate the lamp-powering circuit.

In the preferred embodiment of the present invention, the foregoing object is accomplished by providing a tubular battery-receiving casing having a resilient member at one end urging a first conductor into electrical contact with one terminal of the battery assembly. Such conductor includes a portion extending lengthwise along a side of the casing. At the other end of the flashlight, the lamp assembly includes a conductor having a V-shaped annular portion forming a flared groove. Such annular portion is in electrical contact with the other battery terminal. The switch member is in the form of a long loop of conductive material return bent at both ends and slidable lengthwise of the casing. The leading end of the loop fits in the flared groove of the conductor for a reliable electrical connection, whereas the other end of the loop is biased into contact with the conductor strip extending from the other end portion of the casing.

DETAILED DESCRIPTION

Figure 1:
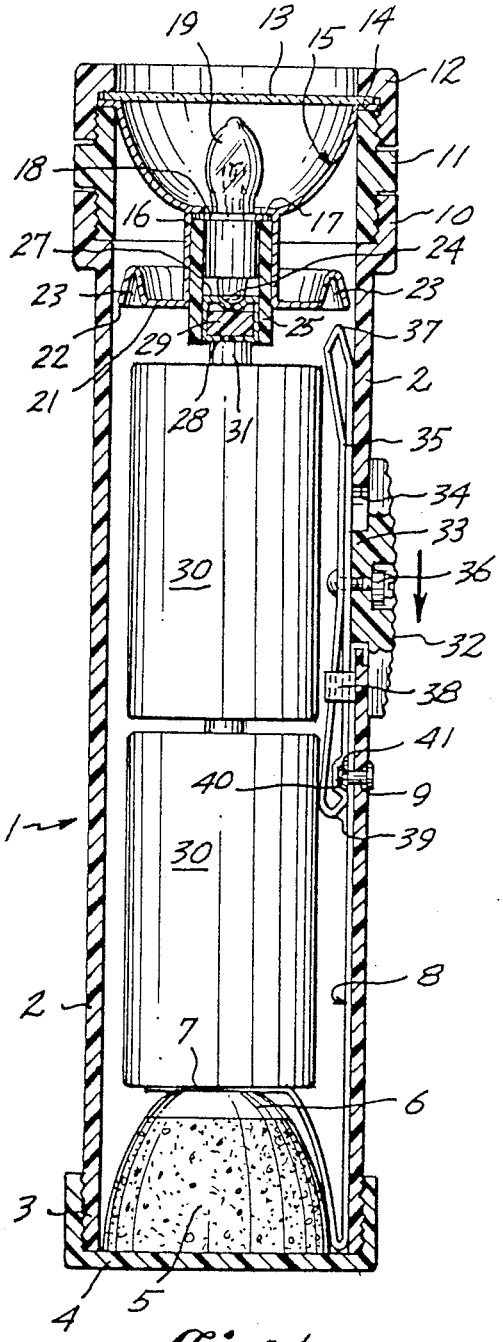
FIG. 1 is a somewhat diagrammatic, longitudinal, axial section of a flashlight in accordance with the present invention.

With reference to FIG. 1, the flashlight 1 in accordance with the present invention includes a tubular casing 2 of insulative material such as plastic having an externally threaded base end portion 3 for an end cap 4 screwed onto and closing the base end of the casing. The base end portion of the casing receives a pad or block 5 of nonmetal, noncorrosive, resilient material such as natural or synthetic rubber or resilient closed cell foam. Preferably, such pad or block 5 is tapered upward to a top rounded end portion 6 against which an inward-projecting leg 7 of a long thin conductor strip 8 engages. Such conductor strip is bent downward alongside the resilient pad or block 5 and extends lengthwise along the inner periphery of the casing to which it is secured such as by a rivet 9.

The other end portion of the casing, the leading or bulb end portion 10, is stepped outward with internal threads for the complemental external threads of an intermediate collar 11. A leading end or upper end cap 12 is screwed onto the upper portion of collar 11 to clamp the marginal portion of the transpaent circular lens 13 and the flat annular lip 14 of a reflector 15 between such end cap 12 and collar 11.

Reflector 15 is part of the lamp assembly which includes the integral, intermediate, conductive cylindrical portion 16 with a top inward-projecting lip 17. The outward-projecting flange or lip 18 of the flashlight bulb or lamp 19 is engaged against the conductor lip 17 from below. The bulb is held in position by a cylindrical insulative plug 20 snugly received in the conductive cylinder 16.

The conductive section of the lamp assembly includes a bottom disk 21, the outer periphery of which is bent pward toward the bulb and downward to the free outer edge 22 forming an annular groove 23 adjacent to the inner periphery of the flashlight casing 2 and of generally V cross section.

Figure 3:
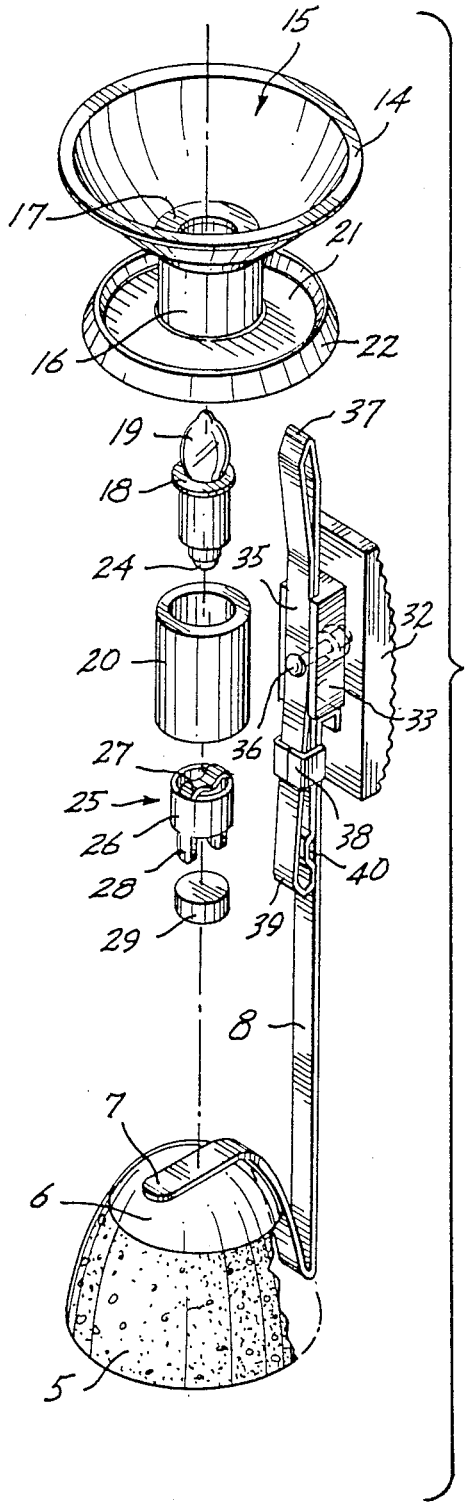
FIG. 3 is a top perspective of the internal components of a flashlight in accordance with the present invention with some parts shown in exploded relationship.

The lip 18 and body of lamp 19 form the negative lamp terminal which is in contact electrically with the conductive disk 21 including its reverse bent annular portion forming the groove 23. The bottom positive terminal 24 of the lamp is engaged against a conductive clip member 25, the construction of which is best seen in FIG. 3. Such clip preferably includes a cylindrical body 26 and upper inturned tabs 27 for engaging against the bottom end portion (positive terminal) of the flashlight bulb. Tabs 28 at the bottom end portion of such clip are bent inward after insertion of a resilient pad or disk 29 which can be of synthetic or natural rubber, for example. Pad 29 biases tabs 27 and 28 relatively apart.

The conventional flashlight batteries 30 are received in the casing end-to-end as is conventional. The essentially flat negative end of the bottom battery is engaged against the inturned section 7 of the bottom conductor strip 8 which inturned section is biased upward by the resilient pad or block 5. The pointed positive terminal 31 of the upper battery is engaged against the bottom tabs 28 of the conductive clip 25 which has the top tabs 27 engaged against the positive terminal 24 of the lamp 19. The top tabs 27 and bottom tabs 28 of the clip are biased apart by the central resilient disk 29 to maintain a reliable electrical connection.

Actuation and deactuation of the lamp are achieved by electrically connecting and disconnecting the conductor strip 8 and the upper conductor disk 21 by a sliding switch 32. Such switch has a rectangular stem 33 received in an elongated slot 34 of the flashlight casing 2. A long conductive loop 35 is connected to the switch such as by a screw 36 for movement with the switch. The flat central portion of loop 35 seats in an inward-opening slot of switch stem 33 to prevent rotation of the loop about the axis of screw 36 as best seen in FIG. 3. Returning to FIGS. 1 and 2, the upper end portion of the loop 35 adjacent to the groove 23 of conductor disk 21 is return bent to form an angular end portion 37 slightly out of registration with the groove 23 and having sides forming an angle greater than the angle formed by the opposite sides of the groove 23. Consequently, when moved upward by sliding the switch, such end portion 37 is wedged inward and its opposite sides are squeezed together to fit in the groove 23, assuring that a reliable electrical connection will be made even after repeated use.

Figure 2:
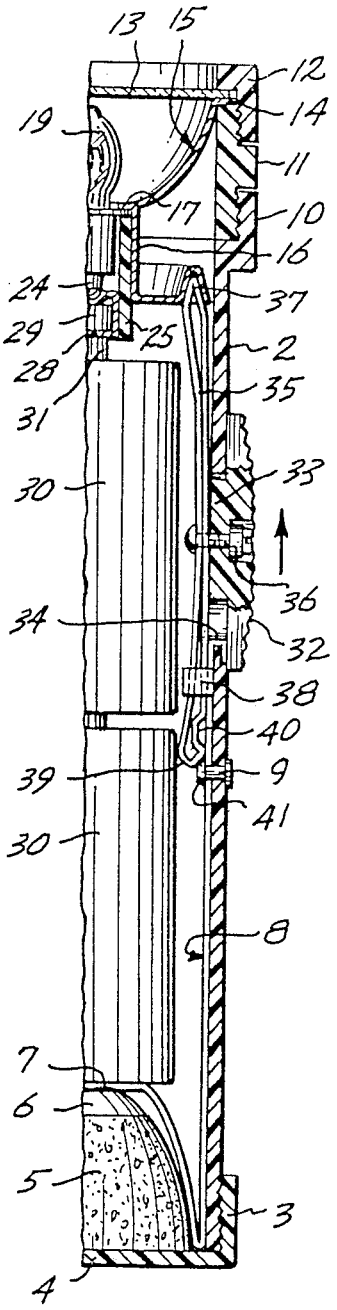
FIG. 2 is a fragmentary, longitudinal, axial section of the flashlight of FIG. 1, with parts in different positions.

The base or bottom end portion of the loop 35 extends through a guide ring or saddle 38 which presses the loop outward toward the casing inner wall for firm connection with the upper end portion of the conductive strip 8. As best seen in FIGS. 1 and 2, shortly above the return bent base end portion 39 of the conductive loop, the inner side of the loop is offset inward to form a notch 40 which, in the unactuated position shown in FIG. 1, closely engages over the enlarged head 41 at the inner end of rivet 9. Consequently, the switch is reliably held in the unactuated position until it is desired to actuate the lamp by manual movement of the switch upward, which squeezes the opposite sides of the base end portion 39 of the conductive loop together as the end of the loop passes over head 41 of rivet 9. In the actuated position shown in FIG. 2, the bottom end portion 39 of the conductive loop rests against the rivet head 41 and, consequently, the loop is reliably held in the actuated position until it is desired to turn off the flashlight.

I claim:

1. In a flashlight having a casing, a battery including first and second terminals and fitted in the casing, a lamp assembly mounted on the casing and including a lamp having first and second terminal portions, the first terminal portion of the lamp being in electrical contact with the first terminal of the battery, a first conductor fixed to the casing and in electrical contact with the second terminal of the battery, the lamp assembly including a second conductor in electrical contact with the second lamp terminal portion and a switch for connecting electrically the first and second conductors to actuate the lamp, the improvement comprising the second conductor including an annular disk having a groove therein and the switch including a third conductor having a first end portion in electrical contact with the first conductor and a second end portion return bent and fittable in the groove.

2. In the flashlight defined in claim 1, the third conductor including a conductive loop slidable in the casing.

3. In the flashlight defined in claim 2, the switch including a stem portion, the casing having an elongated slot receiving said stem portion, said stem portion having an inward-opening slot receiving the central portion of the conductive loop between its first and second end portions.

4. In the flashlight defined in claim 2, the second end return bent portion of the third conductor being offset from the center of the groove of the annular disk such that sliding movement of the third conductor to bring the second end return bent portion into the groove wedges such return bent portion for fitting in the groove.

5. In the flashlight defined in claim 4, the second end return bent portion of the third conductor forming an angle greater than the angle formed by the groove such that the opposite sides of the second end return bent portion of the conductor are squeezed together when fitted in the groove.

6. In the flashlight defined in claim 1, the first conductor including an inward-projecting portion positioned to engage against the second terminal of the battery, the casing having a closed end adjacent to the second terminal of the battery, and including a nonmetallic resilient pad engaged between said conductor portion and said closed end of the casing for biasing said conductor portion against the second terminal of the battery.

7. In the flashlight defined in claim 1, the lamp assembly including a conductive cylindrical section having an inward-projecting lip for engaging against the lamp second terminal portion, a nonconductive cylindrical plug snugly fittable in said conductive cylindrical portion of the lamp assembly to retain the lamp therein and a conductive clip member fitted in said plug and engaged between the first battery terminal and the first lamp terminal portion.

8. In the flashlight defined in claim 7, in which the clip includes inturned tabs engaged, respectively, against the first lamp terminal portion and the first battery terminal, and resilient means for biasing said tabs relatively apart.

9. In the flashlight defined in claim 1, the first end portion of the third conductor including a notch, and the casing including an inward-extending projection positioned to fit in the notch of such end portion to resiliently maintain the third conductor in a selected position.

* * * * *